US005474465A

United States Patent [19]

Kobayashi

[11] Patent Number: 5,474,465

[45] Date of Patent: Dec. 12, 1995

[54] WATERPROOF CONNECTOR

[75] Inventor: Noboru Kobayashi, Yokohama, Japan

[73] Assignee: Kobayashi Denki Kogyo Kabushiki Kaisha, Japan

[21] Appl. No.: 252,946

[22] Filed: Jun. 2, 1994

[30] Foreign Application Priority Data

Jun. 4, 1993 [JP] Japan ..... 5-030049

[51] Int. Cl.[6] ..... H01R 13/52

[52] U.S. Cl. ..... 439/278; 439/272; 439/372

[58] Field of Search ..... 439/278, 372, 439/272, 271, 351, 352, 357, 358

[56] References Cited

U.S. PATENT DOCUMENTS

| | | | |
|---|---|---|---|
| 2,281,739 | 5/1942 | Wright | 439/271 OR |
| 3,478,297 | 11/1969 | Gimpel et al. | 439/278 X |
| 3,562,696 | 2/1971 | Barnhart et al. | 439/278 OR |
| 5,332,330 | 7/1994 | Kaneko | 439/357 X |

FOREIGN PATENT DOCUMENTS

| | | |
|---|---|---|
| 1-13630 | 3/1989 | Japan . |
| 1-27269 | 8/1989 | Japan . |

*Primary Examiner*—Neil Abrams
*Assistant Examiner*—Daniel Wittels
*Attorney, Agent, or Firm*—Graham & James

[57] ABSTRACT

Each of female type contact pieces is surrounded by a flexible elastic member. While a female type connector half is connected to a male type connector half, a plurality of water inflow preventive protuberance slightly projected from the foremost end of the male type connector half are forcibly squeezed in the flexible elastic member, causing the respective contact pieces to be watertightly separated from each other. The repulsive force accumulatively arising in the flexible elastic member due to compression of the latter acts to thrust contact parts in the female type contact portions from the outside in the transverse direction. Thus, an intensity of contact pressure between the female type contact pieces and the male type contact pieces is increased, whereby both the female type contact pieces and the male type contact pieces are reliably connected to each other no matter how they are contaminated with oil. While the female type connector half and the male type connector half are disconnected from each other, they can easily be washed using water. Subsequently, when they are connected to each other, there does not arise a malfunction of short-circuit due to the water remaining after completion of the washing operation.

6 Claims, 5 Drawing Sheets

WATERPROOF CONNECTOR

BACKGROUND OF THE INVENTION

1. Field of the Invention

The present invention relates to a waterproof connector employable for wiring operations to be performed for electrical appliances used in building constructing work sites, road building work sites or the like. More particularly, the present invention relates to improvement of a waterproof connector of the foregoing type which assures that there does not arise a malfunction of short-circuit due to the remaining water when a female connector half and a male connector half are connected to each other after completion of a water washing operation.

2. Description of the Prior Art

Various kinds of electrical appliances employable for civil engineering works, road building works or the like are usually contaminated with mud and soil. For this reason, it is desirable that connectors for electrically connecting electrical appliances to a power source can simply and easily be washed using water.

To prevent water from reaching many contact pieces in the conventional waterproof connector from the outside, an adequate measure has been hitherto taken. However, a malfunction of incorrect waterproofing is comparatively liable to arise between adjacent terminals among many contact pieces. In addition, in the case that a female connector half and a male connector are not connected to each other, the same malfunction of incorrect waterproofing is liable to occur.

In the case that a waterproofing effect is increased while a female connector half and a male connector half are independently or separately held, waterproofing between lines readily becomes incomplete when they are get wetted with water in practical use. Thus, a malfunction of short-circuit is liable to occur.

When a civil engineering work such as a building construction work, a road building work or the like is conducted, electrical appliances are often contaminated with mud and soil. Similarly, connectors for electrically connecting the electrical appliances to a power source are inevitably contaminated with mud and soil. Especially, when each civil engineering work is conducted in the rain, they are contaminated with muddy water.

When a female connector half and a male connector half constituting the conventional waterproof connector are contaminated with muddy water while they are disconnected from each other, contact pieces and associated components are get wetted with the muddy water, resulting in their waterproofing effect being degraded. Since mud adheres to them after they are dried, this leads to the result that incorrect contact is liable to occur between female contact pieces and male contact pieces.

The present invention has been made in consideration of the aforementioned background.

An object of the present invention is to provide a waterproof connector composed of a female connector half and a male connector half connected to each other wherein they are constructed in such a manner as to enable them to be easily washed using water while they are disconnected from each other, and moreover, a malfunction of short-circuit does not arise when they are connected to each other to be put in practical use.

SUMMARY OF THE INVENTION

The present invention provides a waterproof connector composed of a female type connector half and a male type connector half connected to each other wherein the waterproof connector comprises a female type contact piece holding portion for holding the base ends of contact parts of a plurality of female type contact pieces, the female type contact piece holding portion having a cavity formed therein peripheral to the foremost ends of the contact parts of the female type contact pieces; a flexible elastic member filled in the cavity in such a manner as to surround the fore end parts of the female type contact pieces therewith with the exception of projected parts of a plurality of male type contact pieces; engaging means disposed in the vicinity of the foremost end of each of male type and female type contact piece holing portions; a male type contact piece holding portion having fore parts of a plurality of male type contact pieces projected therefrom, the base ends of the plurality of male type contact pieces being immovably held by the male type contact piece holding portion; a plurality of water inflow preventive protuberances slightly projected from the foremost end of the male type contact piece holding portion while surrounding the bottom ends of the projected parts of the plurality of male type contact pieces therewith; and a tightening mechanism for firmly holding both of the female type contact piece holding portion and the male type contact piece holding portion in the connected state while bringing the water inflow preventive protuberances in tight contact with the flexible elastic member in the axial direction of respective contact pieces, the tightening mechanism being constructed such that after male type contact pieces are inserted into female type contact pieces and the water inflow preventive protuberances are squeezed to come in tight contact with the fore end surface of the flexible elastic member on the female type contact piece side, the engaging means on the female connector half side is brought in operative engagement with the engaging means on the male connector half side with operator's hands.

Usually, the tightening mechanism is constructed in the shape of a toggle type clamping mechanism including an engagement stepped part serving as the engaging means on the female type contact piece side to be engaged with a hook portion at the foremost end of a hook member and a lever member turnably supported in the vicinity of the foremost end of the male type contact piece holding portion so as to allow the other end of the hook member to be received in the engaging means on the male type contact piece side.

Alternatively, the tightening mechanism may be constructed in the shape of a cylindrical threadable clamping mechanism including a plurality of female threads formed around the inner peripheral surface of a female-threaded sleeve at the rear end part of the latter and a plurality of male threads formed around the outer peripheral surface of the female type connector half at the fore end part of the latter to be threadably engaged with the female threads. The female-threaded sleeve is rotatably fitted onto the male type connector half with a disconnection preventive portion formed integral therewith at the foremost end thereof.

While the female type connector half is connected to the male type connector half, the respective female contact pieces are surrounded by the flexible elastic member. At this time, since the water inflow preventive protuberances are squeezed in the flexible elastic member to come in tight contact with the latter, the repulsive force accumulatively arising in the flexible elastic member due to compression of the latter acts to thrust the contact parts of the female type contact pieces from the outside in the transverse direction, causing an intensity of contact pressure between the female type contact pieces and the male type contact pieces to be increased. Consequently, both of the female type contact pieces and the male type contact pieces are reliably brought in contact with each other irrespective of some contamination of them with oil.

Since each water inflow preventive projection is formed in such a manner as to surround the corresponding male type contact piece therewith, the contact parts of the female and male contact pieces (serving as electrodes) are independently watertightly separated from each other. Thus, a malfunction of short-circuit does not arise due to the water remaining immediately after completion of a water washing operation.

In addition, since the female type connector half and the male type connector half are firmly connected to each other while the squeezing force induced by actuating the tightening mechanism is applied to them in the axial direction, there does not arise a malfunction that both the connector halves are undesirably disconnected from each other due to a shock imparted to them in the transverse direction and a tensile load abruptly applied to them in the axial direction.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

Figure 1:
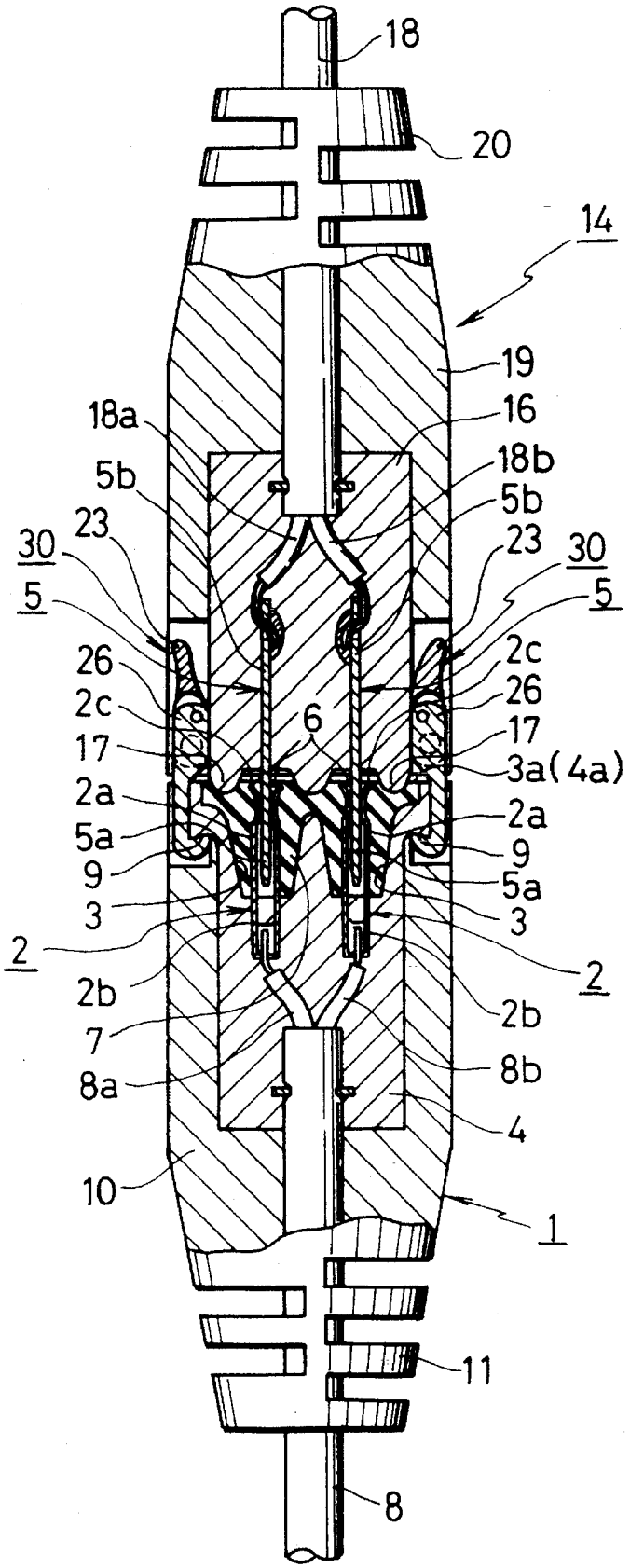
FIG. 1 is a vertical sectional view of a waterproof connector constructed according to a first embodiment of the present invention, showing the operative state that a female type connector half and a male type connector half are connected to each other in the axial direction.
Figure 2:
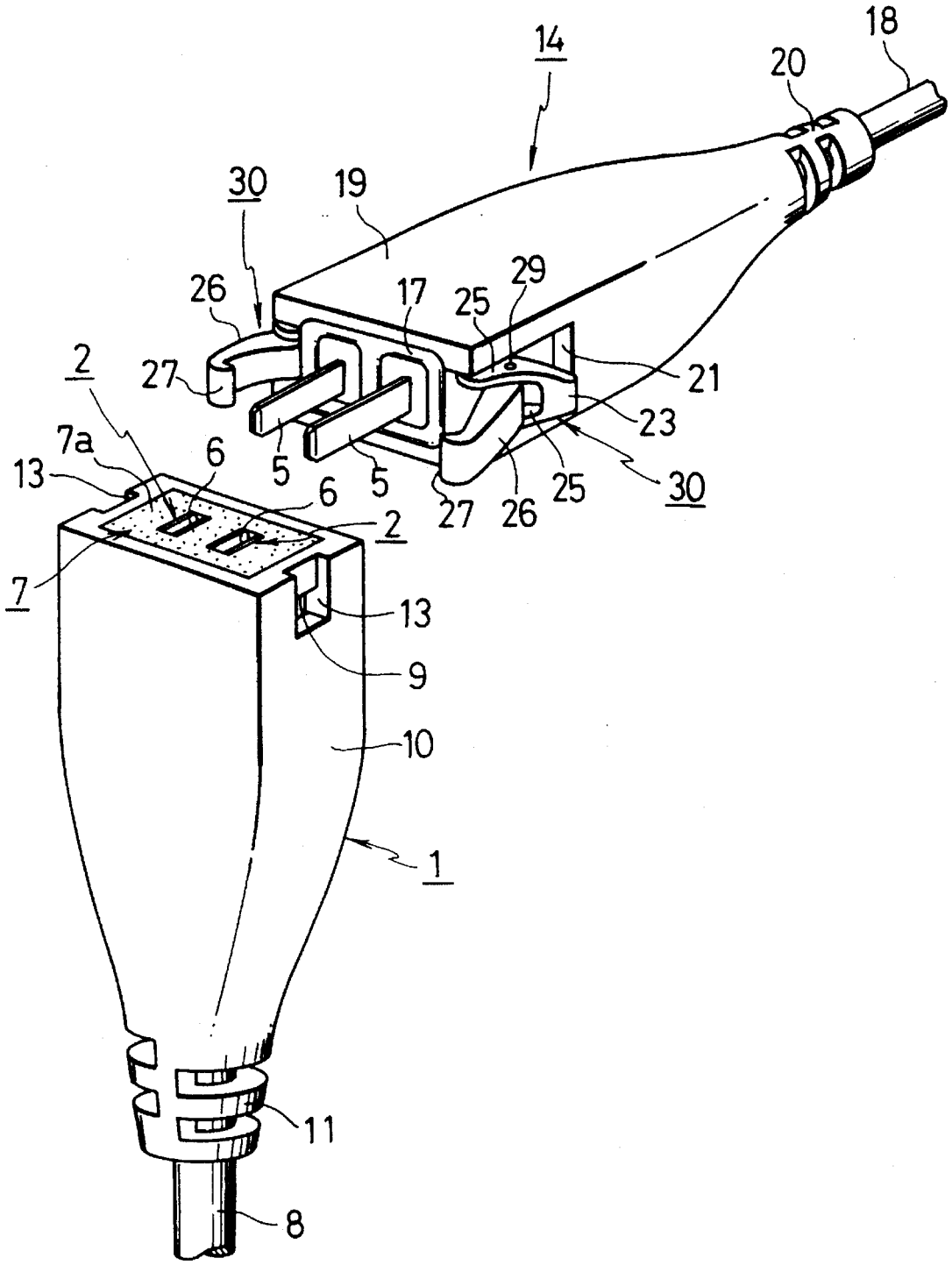
FIG. 2 is a perspective view of the waterproof connector in FIG. 1, showing the inoperative state that the male type connector half is disconnected from the female type connector half.
Figure 3:
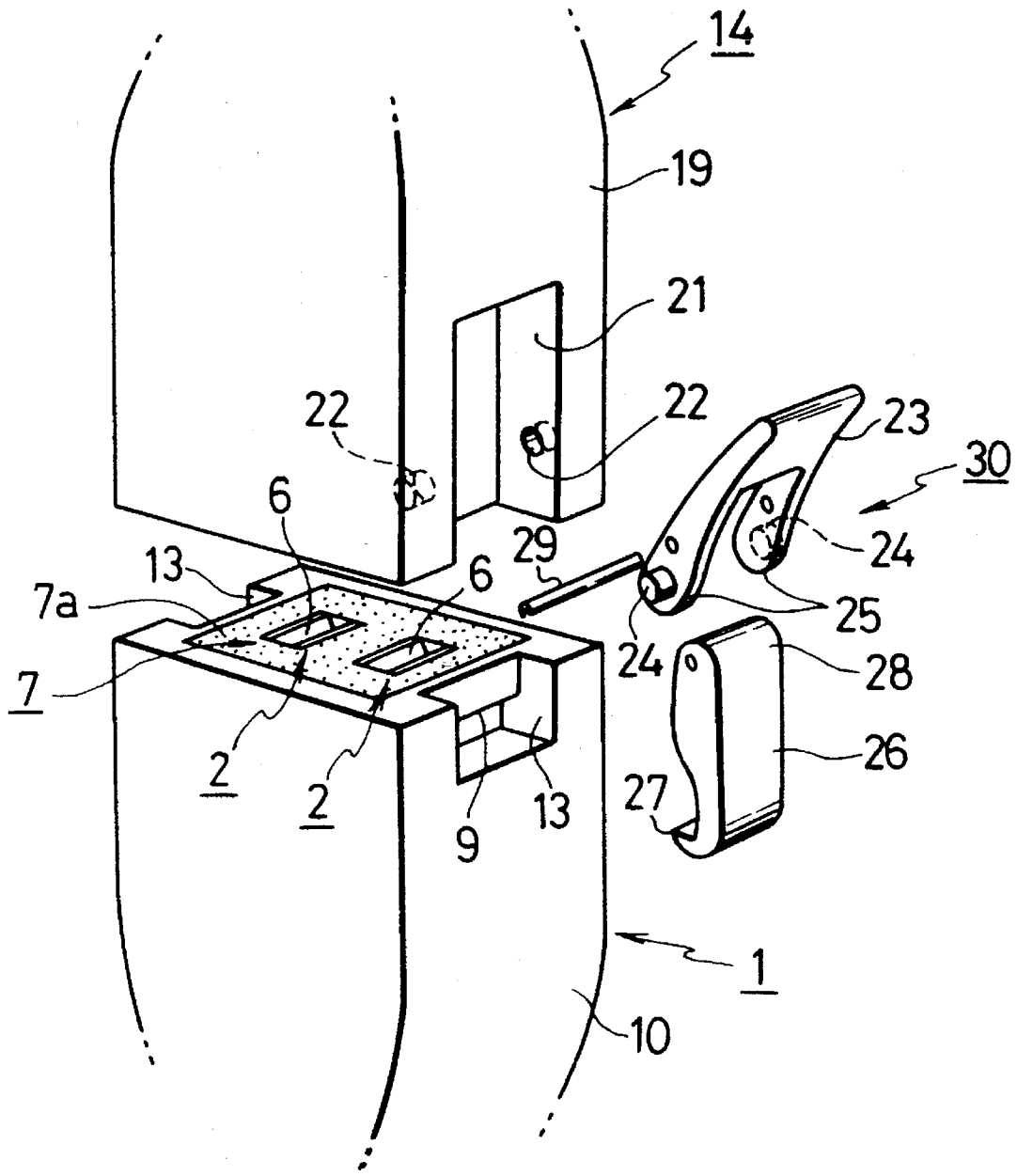
FIG. 3 is a fragmentary perspective view of the waterproof connector in the partially disconnected state, showing by way of example a tightening mechanism for firmly connecting the female type connector half and the male type connector half to each other.

FIG. 1 to FIG. 3 show a waterproof connector constructed according to a first embodiment of the present invention, respectively, wherein FIG. 1 is a vertical sectional view of the waterproof connector, showing the operative state that a female type connector half and a male type connector half are connected to each other in the axial direction, FIG. 2 is a perspective view of the waterproof connector, showing the inoperative state that the male type connector half is disconnected from the female type connector half, and FIG. 3 is a fragmentary perspective view of the waterproof connector in the partially disconnected state, showing by way of example a tightening mechanism for firmly connecting the female type connector half and the male type connector half to each other. Especially, FIG. 3 is intended to shows essential components constituting the tightening mechanism in the disassembled state.

The female type connector half generally designated by reference numeral 1 includes a female type contact piece holding portion 4 having a cavity 3 formed peripheral to foremost end parts 2*a* of female type contact pieces 2 to hold bottom ends 2*b* of the latter therewith and a flexible elastic member 7 filled in the cavity 3 of the female type contact piece holding portion 4 in such a manner as to surround the fore end parts 2*a* of the female type contact pieces 2 therewith with the exception of the received part of the male type contact pieces 5.

Each of the female type contact pieces 2 is formed such that a flat plate is folded to exhibit an elongated U-shaped contour so as to allow a flat plate-shaped male type contact piece 5 to be received in the corresponding female type contact piece 2 in the clamped state, and the bottom ends 2*b* of the female type contact pieces 2 positionally coincident with the folded parts of flat plates are connected to cores 8*a* and 8*b* of a wiring cable 8 by soldering. As is best seen in FIG. 1, the base ends 2*b* of the female type contact pieces 2 are immovably embedded in the female type contact piece holding portion 4 molded of a hard synthetic resin.

The cavity 3 located remote from the bottom ends 2*b* of the female type contact pieces 2 while surrounding the fore ends 2*a* of the same is formed at the same time when the female type contact piece holding portion 4 is molded, and an upper end 3*a* of the cavity 3 (positionally coincident with a foremost end surface 4*a* of the female type contact piece holding piece 4) has the substantially same height as that of a foremost end 2*c* of each female type contact piece 2.

A flexible elastic member 7 such as an elastic rubber, a soft synthetic resin having no gas bubble formed therein or the like is filled in the cavity 3, and a foremost end surface 7*a* of the flexible elastic member 7 is positionally coincident with the foremost end surface 4*a* of the female type terminal holding portion 4, the foremost end 3*a* of the cavity 3 and the foremost end 2*c* of each female type contact piece 2.

Engagement stepped parts 9 (serving as engaging means) each of which cross-sectional area is enlarged in the forward direction are formed on the opposite sides of the female type terminal piece holding portion 4 in the vicinity of the outer surface of the latter as seen in the transverse direction.

The female type contact piece holding portion 4 is covered with a sheath 10 molded of a soft synthetic resin with the exception of a foremost end part thereof. In addition, to facilitate bending of the; cable 8, a plurality of bending portions 11 are molded of the same synthetic resin as that of the sheath 10 at the lower end part of the female type connector half 1.

Each of the engagement stepped parts 9 is formed on the sheath 10 in the shape of a groove 13 having a predetermined width and exposed to the outside at the foremost end of the contact piece holding portion 4.

On the other hand, the male type connector half generally designated by reference numeral 14 includes a male type contact piece holding portion 16 from which fore end parts 5*a* of male type contact pieces 5 each serving as a contact part are projected, and bottom ends 5*b* of the male type contact piece 5 are immovably embedded in the male type contact piece holding portion 16.

Water inflow preventive portions 17 are projected from the lowermost end of the male type contact piece holding portion 16 while surrounding the male type contact pieces 5 therewith at the locations positionally coincident with the base ends of the projected parts of the male type contact pieces 5.

Each water inflow preventive portion 17 completely surrounds the corresponding male type terminal 5 without any possibility that water enters the male type contact piece holding portion 16.

Bottom ends **5*b* of the male type contact pieces 5 are connected to cores 19*a* and 18*b* of a wiring cable 18 by soldering, and they are immovably embedded in the male type terminal piece holding portion 18** molded of a hard synthetic resin.

The male type contact piece holding portion 18 is covered with a sheath 19 molded of a soft synthetic resin with the exception of the lowermost end part thereof, and to facilitate bending of the cable 18, a plurality of bending portions 20 are molded with the same synthetic resin as that of the sheath 19.

While the male type connector half 14 is connected to the female type connector half 1, grooves 21 each having a width appreciably larger than that of each groove 13 are formed at the lower end part of the sheath 19 of the male type connector half 14 corresponding to the grooves 13 having the stepped parts 9 exposed to the outside while orienting in the same direction as that of the grooves 13.

As shown in FIG. 3, shaft holes 22 are formed through each groove 21 of the male type connector half 14 on the fore side of the groove 21 (on the lower side of the groove 21 in the shown case) so as to allow pivotal shafts 24 disposed outside of a bifurcated lever 23 to be fitted into the shaft holes 22.

An opposite end 28 oil an engagement hook 26 to a hook portion 27 of the latter is turnably supported between the opposite feet 25 of the bifurcated lever 23 with the aid of a pin 29 at the position located slightly inside of the center axis of the pivotal shafts 24.

The engagement hook 26 of the bifurcated lever 23 constitutes a toggle clamp type tightening mechanism 30.

In operation, the tightening mechanism 30 is actuated in the following manner. First, the male type contact pieces 5 are inserted into the female type contact pieces 2, and then, the water inflow preventive protuberances 17 on the male type contact piece 5 side are brought in contact with the upper end surface **7*a* of the flexible elastic member 7 on the female type contact piece 2 side. Thereafter, the hoot portion 27 of the engagement hook piece 26 (serving as operative engaging means) of the male type connector half 14 is engaged with the engagement stepped part 9 (serving as engaging means) of the female type connector half 1, and subsequently, the bifurcated lever 23 is turnably actuated with an operator's hand until it is fully received in the groove 21. At this time, since the water inflow inhibitive protuberances 17 are squeezed in the flexible elastic member 7 while the former is kept in tight contact with the latter in the axial direction of the contact pieces 2 and 5, the bifurcated lever 23 is immovably held in the groove 21 with the aid of the toggle type clamping mechanism 30 under the influence of the repulsive force induced by the elastic squeezing of the water inflow preventive members 17 in,the flexible elastic member 7, causing both the contact piece holding portions 4 and 16** to be reliably connected to each other.

Specifically, while the female type connector half 1 and the male type connector half 14 are operatively connected to each other, the water inflow inhibitive protuberances 17 are forcibly squeezed in the flexible elastic member 7. At this time, the repulsive force accumulatively arising in the flexible elastic material 7 due to compression of the latter acts to thrust the fore end parts **2*a* of the female type contact pieces 2, i.e., contact parts of the latter from the outside in the transverse direction, whereby the female type contact pieces 2 and the male type contact pieces 5** come in reliable contact with each other with an increased intensity of contact pressure.

In addition, since each of the water inflow preventive protuberances 17 is formed in such a manner as to surround the corresponding male type contact piece 5 therewith, both the female and male contact parts (serving as electrodes) are watertightly separated from each other. Thus, there does not arise a malfunction such as short-circuit or the like due to the water remaining immediately after completion of a water washing operation.

With this construction, the female type connector half 1 and the male type connector half 14 are firmly connected to each other in the axial direction. Thus, there does not arise a malfunction that both the connector halves 1 and 14 are undesirably disconnected from each other due to a shock imparted to them in the transverse direction or a tensile load abruptly applied to them in the axial direction.

Figure 4:
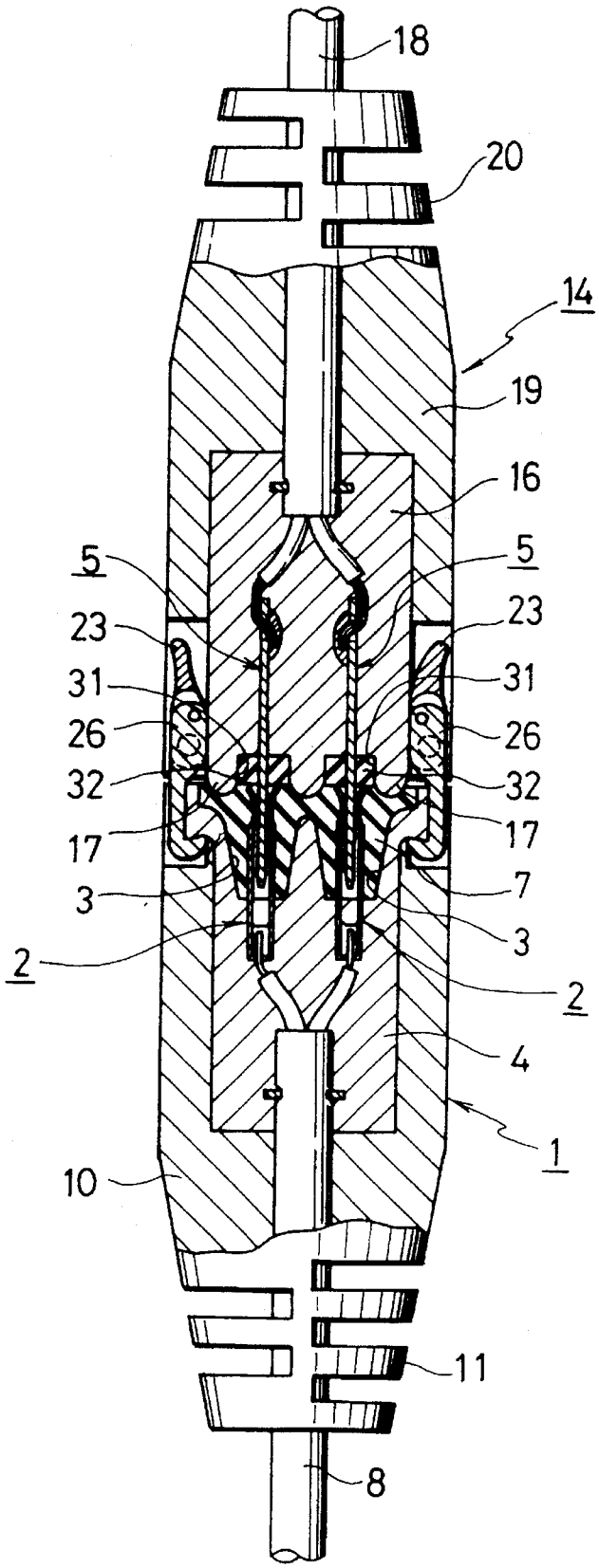
FIG. 4 is a vertical sectional view of a waterproof connector similar to FIG. 1, showing the structure of the waterproof connector constructed according to a second embodiment of the present invention.

FIG. 4 is a vertical sectional view of a waterproof connector constructed according to a second embodiment of the present invention. In this embodiment, a male type connector half 14 includes flexible elastic members 31 molded of a material similar to that for flexible elastic members 7 in a female type connector half 1, and each of the flexible elastic members 31 is embedded at the bottom part of each of male type contact pieces 5 in the male type connector half 14. The same parts or components as those constituting the waterproof connector shown in FIG. 1 are designated by the same reference numerals. Repeated on them will not be required for the purpose of simplification.

Specifically, recesses 32 are formed inside of water inflow preventive protuberances 17 at the bottoms of contact piece holding portions 18, and the flexible elastic members 31 are filled in the recesses 32. It should be noted that the lower surface of each flexible elastic member 31 is located slightly lower than the uppermost end of each water inflow preventive protuberance 17.

With this construction, watertightness between a male type contact piece holding portion 18 and male type contact pieces 5 at the bottom of a male type connector half 14 can be improved, and moreover, individual watertightness between adjacent contact pieces (serving as electrodes) at the time when the female type connector half 1 and the male type connector half 14 are connected to each other can also be improved.

Figure 5:
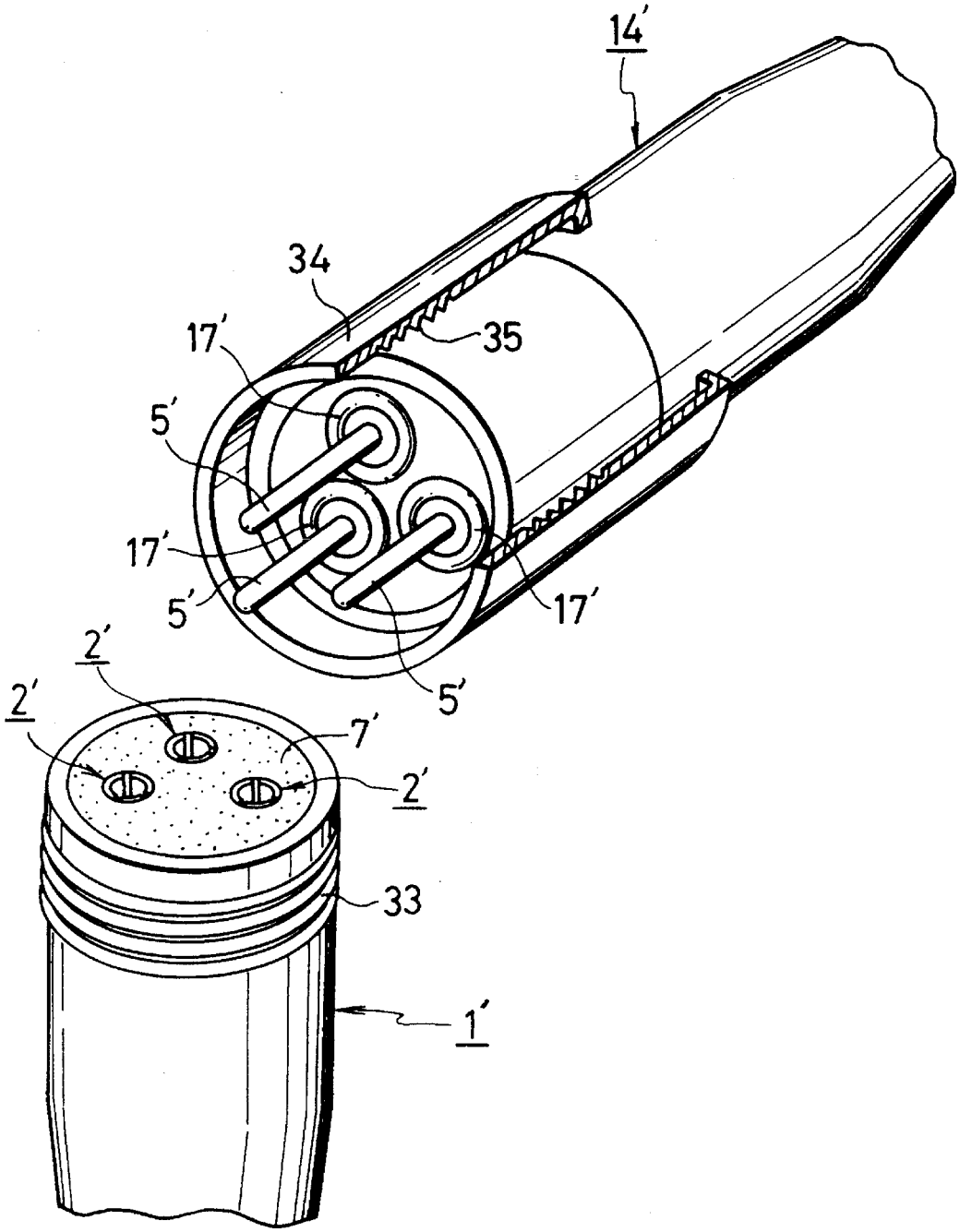
FIG. 5 is a perspective view of a waterproof connector constructed according to a third embodiment of the present invention, showing the inoperative state that a male type connector half is disconnected from a female type connector half by utilizing another type of tightening mechanism.

FIG. 5 is a perspective view of a waterproof connector constructed according to a third embodiment of the present invention wherein a female type connector half and a male type connector half are shown in the disconnected state and a tightening mechanism different from the tightening mechanism 30 in the preceding embodiments is employed for the waterproof connector. Parts or components each having a contour different from that shown in the preceding embodiments but exhibiting the same function as that in the preceding embodiments are designated by the same reference numerals having a mark (') added thereto. Repeated description on them will not be required for the purpose of simplification.

In this embodiment, a tightening mechanism is constructed in the form of a threadable clamping mechanism in the same manner as a cannon type connector. When a cylindrical female type connector half 1' is connected to a cylindrical male type connector half 14', a certain intensity of thrusting force is applied to the waterproof connector in the axial direction to generate a certain intensity of compressive force between a flexible elastic member 7' having female type contact pieces 2' surrounded thereby and water inflow preventive protuberances 17' at the bottoms of male type contact pieces 5'.

In FIG. 5, reference numeral 33 designates a plurality of male threads formed around the outer peripheral surface of the female type connector half 1' in the vicinity of the foremost end of the latter, and reference numeral 34 designates a female-threaded sleeve loosely fitted around the outer peripheral surface of the male type connector half 14' to be threadably engaged with the female type connector half 1' via a plurality of female threads 35 formed around the inner peripheral surface thereof. To prevent the male type connector half 14' from being undesirably disconnected from the female type connector 1', a disconnection preventive portion is formed integral with the female-threaded sleeve 34 at the foremost end of the latter.

Since the waterproof connector is constructed according to the present invention in the above-described manner, the following advantageous effects are obtainable.

(a) While the female type connector half and the male type connector half are connected to each other, the water inflow preventive protuberances on the male type connector half are forcibly squeezed in the flexible elastic member on the female type connector side. Thus, the repulsive force accumulatively arising due to compression of the flexible elastic member acts to thrust contact parts of the female type contact pieces from the outside in the transverse direction, causing an intensity of contact pressure between the female type contact pieces and the male type contact pieces to be increased. This assures that the contact state is reliably maintained between both the female type contact pieces and the male type contact pieces irrespective of some contamination of these contact pieces with oil.

(b) Since each water inflow preventive protuberance is formed in such a manner as to surround the corresponding male type contact piece therewith, the contact parts (each serving as an electrode) of the female type contact pieces are watertightly separated from each other. Thus, there does not arise a malfunction of short-circuit due to the water remaining immediately after completion of each water washing operation.

(c) Since the female type connector half and the male type connector half are firmly connected to each other so as to allow a high intensity of: squeezing force to be applied to the waterproof connector in the axial direction, there does not arise a malfunction that the female type connector half is readily disconnected from the male type connector half due to a shock imparted to the waterproof connector in the transverse direction and a tensile force abruptly applied to the waterproof connector in the axial direction.

While the present invention has been described above with respect to a few preferred embodiments thereof, it should of course be understood that the present invention should not be limited only to these embodiments but various change or modification may be made without any departure from the scope of the present invention as defined by the appended claims.

What is claimed is:

1. A waterproof connector composed of a female type connector half and a male type connector half connected to each other, comprising;

a female type contact piece holding portion for holding the base ends of contact parts of a plurality of female type contact pieces, said female type contact piece holding portion having a cavity formed therein peripheral to the foremost ends of said contact parts of said female type contact pieces, a flexible elastic member filled in said cavity in such a manner as to surround the fore end parts of said female type contact pieces therewith with the exception of projected parts of a plurality of male type contact pieces, engaging means disposed in the vicinity of the foremost end of each of female type and male type contact piece holding portions, a male type contact piece holding portion having fore parts of a plurality of male type contact pieces projected therefrom, the base ends of said plurality of male type contact pieces being immovably held by said male type contact piece holding portion, a plurality of water inflow preventive protuberances slightly projected from the foremost end of said male type contact piece holding portion while surrounding the bottom ends of the projected parts of said plurality of male type contact pieces therewith, and a tightening mechanism for firmly holding both of said female type contact piece holding portion and said male type contact piece holding portion in the connected state while bringing said water inflow preventive protuberances in tight contact with said flexible elastic member in the axial direction of respective contact pieces, said tightening mechanism being constructed such that after male type contact pieces are inserted into female type contact pieces and said water inflow preventive protuberances are squeezed to come in tight contact with the fore end surface of said flexible elastic member on the female type contact piece side, said engaging means on the female type connector half side is brought in operative engagement with said engaging means on the male connector half side with operator's hands.

2. The waterproof connector as defined in claim 1, wherein said male type contact piece holding member includes a plurality of recesses each having a predetermined depth which are formed inside of said water inflow preventive protuberances, and a flexible elastic member is filled in each of said recesses.

3. The waterproof connector as defined in claim 1, wherein said tightening mechanism is constructed in the shape of a toggle type clamping mechanism including an engagement stepped part serving as said engaging means on the female type contact piece side to be engaged with a hook portion at the foremost end of a hook member and a lever member turnably supported in the vicinity of the foremost end of said male type contact piece holding portion so as to allow the other end of said hook member to be received in said engaging means on the male type contact piece side.

4. The waterproof connector as defined in claim 1, wherein said tightening mechanism is constructed in the shape of a cylindrical threadable clamping mechanism including a plurality of female threads formed around the inner peripheral surface of a female-threaded sleeve at the rear end part of the latter and a plurality of male threads formed around the outer peripheral surface of said female type connector half at the fore end part of the latter to be threadably engaged with said female threads, said female-threaded sleeve being rotatably fitted onto said male type connector half with a disconnection preventive portion formed integral therewith at the foremost end thereof.

5. The waterproof connector as defined in claim 1, wherein each of said female type contact piece holding portion and said male type contact piece holding portion is molded of a hard synthetic resin.

6. The waterproof connector as defined in claim 1, wherein said flexible elastic member is molded of a comparatively soft elastic rubber, a soft synthetic resin having no gas bubble formed therein or the like.

* * * * *